US007303153B2

(12) United States Patent
Han et al.

(10) Patent No.: US 7,303,153 B2
(45) Date of Patent: Dec. 4, 2007

(54) SIDE AND CORNER STRIP NOZZLE

(75) Inventors: Steve Han, Upland, CA (US); Harold Miller, Upland, CA (US)

(73) Assignee: Rain Bird Corporation, Glendora, CA (US)

( * ) Notice: Subject to any disclaimer, the term of this patent is extended or adjusted under 35 U.S.C. 154(b) by 258 days.

(21) Appl. No.: 11/033,192

(22) Filed: Jan. 11, 2005

(65) Prior Publication Data

US 2006/0150899 A1 Jul. 13, 2006

(51) Int. Cl.
*B05B 1/26* (2006.01)
*B05B 1/34* (2006.01)
*B05B 15/10* (2006.01)

(52) U.S. Cl. ..... 239/461; 239/463; 239/483; 239/498; 239/203; 239/204; 239/201

(58) Field of Classification Search ..... 239/461, 239/463, 483, 494, 498, 200–207
See application file for complete search history.

(56) References Cited

U.S. PATENT DOCUMENTS 1,335,267 A * 3/1920 Grant et al. ..... 239/553.5
2,746,792 A * 5/1956 Hough ..... 239/276
5,381,959 A * 1/1995 Malkin ..... 239/201
5,642,861 A * 7/1997 Ogi et al. ..... 239/568
6,158,675 A 12/2000 Ogi
7,097,113 B2 * 8/2006 Ivans ..... 239/1

OTHER PUBLICATIONS

Tech Specs, Matched Precipitation Rate (MPR) Nozzles, © 1998 Rain Bird Corporation, 4 pages.
Tech Specs, Plastic U-Series Nozzles, © 2003 Rain Bird Corporation, 4 pages.
Photograph of Rain Bird Corporation 15 SST Nozzle, illustrating a commercially available spray nozzle prior to Jan. 11, 2004, 1 page.

* cited by examiner

*Primary Examiner*—Davis D. Hwu
(74) *Attorney, Agent, or Firm*—Fitch, Even, Tabin & Flannery

(57) ABSTRACT

A spray head provided with a plurality of nozzles defined by a base and a deflector cap. Each nozzle is provided with a deflector portion or nozzle plate for directing an upward traveling fluid in an outward direction. Furthermore, the deflector portion may be provided with steps or vanes for altering and varying the flow characteristics of a fluid spray pattern exiting the nozzle. In this manner, different portions of the fluid spray pattern may be projected to varying distances so that the fluid may cover an area having generally straight boundaries and having one or more right angles. Furthermore, the fluid spray pattern may be used to cover a triangular area. In this manner, overspray is reduced. The areas covered by independent nozzles of the spray head may be proximally located by their arrangement within the spray head so as to minimize overlap of the areas.

30 Claims, 7 Drawing Sheets

SIDE AND CORNER STRIP NOZZLE

FIELD OF THE INVENTION

This invention is directed to a spray head of an irrigation system and, in particular, to a new and improved spray head providing a spray pattern over a substantially rectangular area.

BACKGROUND OF THE INVENTION

Currently, many different types of sprinklers have been developed and are specialized for different purposes. One common sprinkler comprises a stationary spray head adapted to mount on an upper end of a fixed or pop-up water supply riser. Such a spray head includes one or more water outlets, or spray nozzles, shaped for distributing irrigation water to surrounding vegetation such as grass, shrubs, crops, and other plants. A prime goal for all irrigations systems is efficient and uniform distribution of water over a particular, desired area.

A common measure of irrigation uniformity and efficiency is a scheduling coefficient (SC), which reflects how much extra watering an entire area must receive for every section to receive sufficient water. More specifically, the portion of the area that will receive the least amount of water is identified. This portion is referred to as a critical area. The average amount of water applied throughout the area is determined, and it is then divided by the amount of water received by the critical area. Under ideal conditions, the amount of water received by any area will equal the average amount received over the entire area, and the ratio between these amounts would equal 1.0. Under typical, less than ideal conditions, the SC ratio would be greater than 1.0. Accordingly, the closer to 1.0 that the calculated SC is, the closer to perfect irrigation uniformity and efficiency achieved by the irrigation system.

Typically, the spray heads mounted to a riser are formed from a deflector cap and base, which together define internal flow paths leading to one or more spray outlets or nozzles. Each nozzle distributes water over a desired area in a spray pattern determined by the size, shape, and geometry of the spray nozzle itself, as well as the inlet supply fluid or water flow rate and pressure. For instance, the spray nozzles may be designed to provide an approximate spray pattern radiating from the sprinkler head in a quarter-circle, half-circle, full-circle, or some other portion of a circle. In this manner, the area receiving the spray pattern is typically a circular wedge radiating from the sprinkler head. Though attempts have been made to adapt nozzles to distribute water over an area such as a rectangular area that is not defined as a circular wedge, such attempts have typically suffered difficulties with efficiency and uniformity of distribution.

There are two basic common approaches to irrigating a rectangular area. The first is to simply use a single spray head that has spray nozzles configured to cover a desired area with a wedge-shaped spray sufficiently large to exceed the rectangular area. However, this approach results in significant overspray onto surrounding areas outside of the rectangular area or under watering areas close-in to the spray head. For example, this approach produces overspray from a side yard such that the sprinkler sprays homes or on a neighbor's property, overspray from a boulevard median such that passing vehicles are sprayed, or overspray from a grass strip between a sidewalks and streets that sprays pedestrians or passing vehicles. In addition, a single spray head typically distributes water unevenly because the spray head is unable to project water to proximal and distal regions for even volume distribution over the area to which water is distributed, particularly under varying supply water pressures.

The second approach for covering a rectangular area is to utilize a plurality of sprinkler heads with each having spray nozzles designed for distributing water to a wedge-shaped area. Accordingly, wedge-shaped or circular areas must overlap to irrigate the rectangular area, resulting in inefficient distribution. Furthermore, this approach only serves to reduce the amount of unwanted overspray.

Accordingly, there is a need for an improved spray head that is capable of uniformly and efficiently irrigating a generally rectangular area with little or no overspray.

DESCRIPTION OF THE PREFERRED EMBODIMENTS

Referring to FIGS. 1-13, there are illustrated exemplary embodiments of spray heads embodying features of the present invention for distributing water over generally rectangular areas. Prior attempts at using a single spray head to water a substantially rectangular area have resulted in uneven water distribution or significant watering of unintended areas. For instance, as illustrated in FIG. 14, a prior-art spray head 1000 located at a corner of rectangular area 1010 projects water in a uniform arc to cover an area that is a portion of a circle, such as a arcuate wedge-shaped area. The spray head 1000 projects water over principal area 1030 over the distance and width of the area 1030, but underwaters area 1020 that is close in to the spray head 1000. Accordingly, the water distribution from the spray head 1000 is highly uneven (high SC).

Figure 14:
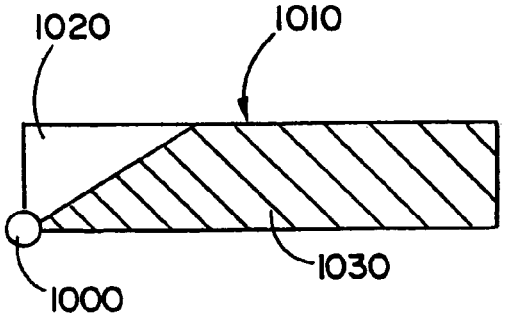
FIG. 14 (PRIOR ART)
FIG. 14 is a representational view of a spray pattern and coverage area for a PRIOR-ART spray head.
Figure 15:
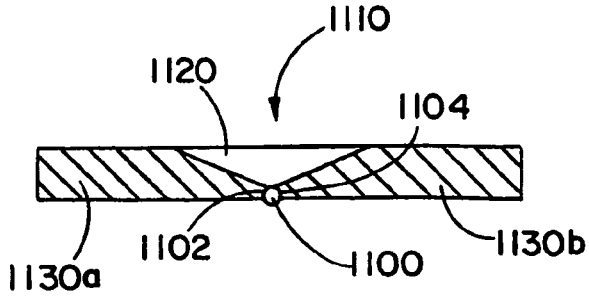
FIG. 15 (PRIOR ART)
FIG. 15 is a representational view of a spray pattern and coverage area for a PRIOR-ART spray head.

Similarly, a prior-art dual outlet spray head 1100 is illustrated in FIG. 15 for watering area 1110 with principal areas 1130*a* and 1130*b*. The outlets 1102, 1104 of the spray head 1100 are substantially identical to those of the spray head 1000 of FIG. 14, and water from each is distributed in an arc over the distance and width of each principal area 1130*a* and 1130*b*. Therefore, each outlet 1102, 1104 of the spray head 1100 suffers from the same deficiencies discussed above for the spray head 1000.

Referring now to FIGS. 1-6, a first embodiment of a spray head 10 embodying features of the present invention is illustrated. The spray head 10 is, in use, utilized for watering a generally rectangular strip of ground surface area when the spray head 10 is positioned at one end and in a corner of the ground surface area. As depicted, the spray head 10 is a right corner strip (RCS) spray head such that it is positioned at a corner of the right, shorter end of the rectangular ground surface area and is directed to distribute water towards the other corner of the same right end and across the ground area towards the left end. However, it should be noted that a left corner strip (LCS) spray head, depicted in FIG. 13, generally has a reversed configuration and operates in the same manner.

The spray head 10 is secured to an end of a riser 20 which may be a stationary riser, a pop-up riser, or another tube or pipe for delivering water to the spray head 10. Specifically, the spray head 10 includes a base assembly 12 having a generally cylindrical body 13 with a generally cylindrical lower portion 12*a*, a generally cylindrical upper portion 12*b*, and a central disc portion 12*c* with a boss 50 rising therefrom, as will be described in further detail below. The lower portion 12*a* has an internal thread 24 that mates with an external thread 26 formed on the upper portion of the riser 20.

The spray head 10 may be equipped with a rock screen 28 located within the path of the incoming water stream and including a peripheral flange 32. The lower portion 12*a* forms an inner shoulder 36 with the disc portion 12*c*, the shoulder 36 being located a short distance from a top end 35 of the riser 20 when the spray head 10 is secured thereto. The peripheral flange 32 of the rock screen 28 is positioned between the inner shoulder 36 and the top end 35 of the riser 20 to secure the rock screen 28 between the riser 20 and the base assembly 12.

The rock screen 28 has a central opening or port 30 through which the incoming water stream from the riser 20 initially flows. The port 30 is defined by a non-porous body 38 of the rock screen 28 such that the incoming water is generally permitted to flow only through the port 30. Preferably, the body is frusto-conical such that the port 30 is positioned within the riser 20. In this manner, the water that has passed through the port 30 can properly develop a flow profile through the lower portion 12*a* of the base assembly 12.

In addition, the port 30 is positioned within the riser 20 so that the rock screen 28 may cooperate with a flow regulator 41 provided by the spray head 10. Specifically, the flow regulator 41 is located along the central axis X of the spray head 10, and its height may be adjustably positioned relative to the rock screen 28 to increase or decrease the amount of water flowing through the port 30. As is depicted, the flow regulator 41 is in the form of a throttling screw 42 having a throttling head 40 with a lower end 42*a* generally in the path of the water stream passing through the port 30. At an opposite end 42*b*, the throttling screw 42 is exposed at the top, external side 10*a* of the spray head 10 such that a user may manipulate the throttling screw 42. It is preferred that the end 42*b* of the throttling screw 42 is equipped with a recess or slot 42*c* for receiving a tool (not shown) such that the throttling screw 42 may be threadably rotated to adjust the position of the throttling head 40 along the central axis X and relative to the port 30. When the throttling screw 42 is rotatably adjusted, the throttling head 40 is translated toward or away from the port 30 depending on the direction of rotation to regulate water flow to the spray head.

Figure 1:
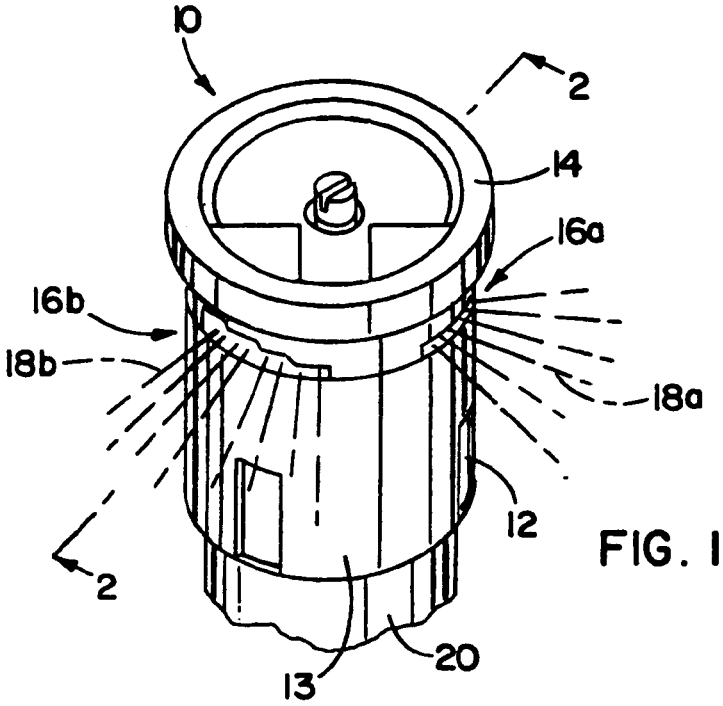
FIG. 1 is a perspective view of a spray head embodying features of the present invention.
Figure 2:
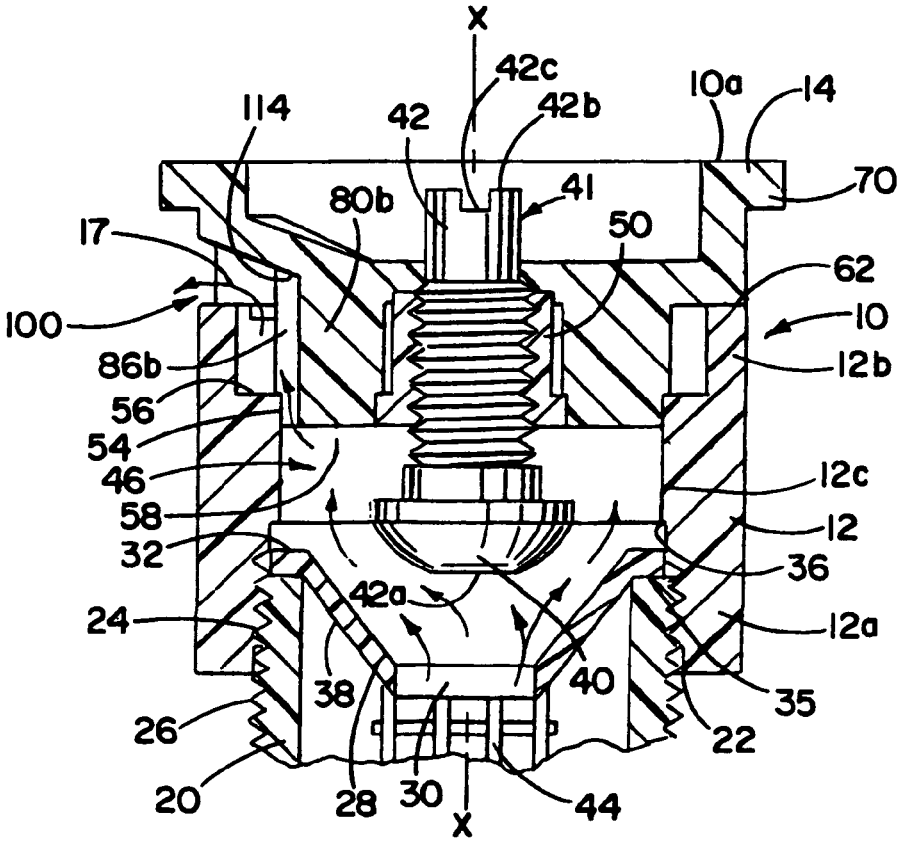
FIG. 2 is a cross-sectional view of the spray head of FIG. 1 taken along line 2-2 of FIG. 1.
Figure 3:
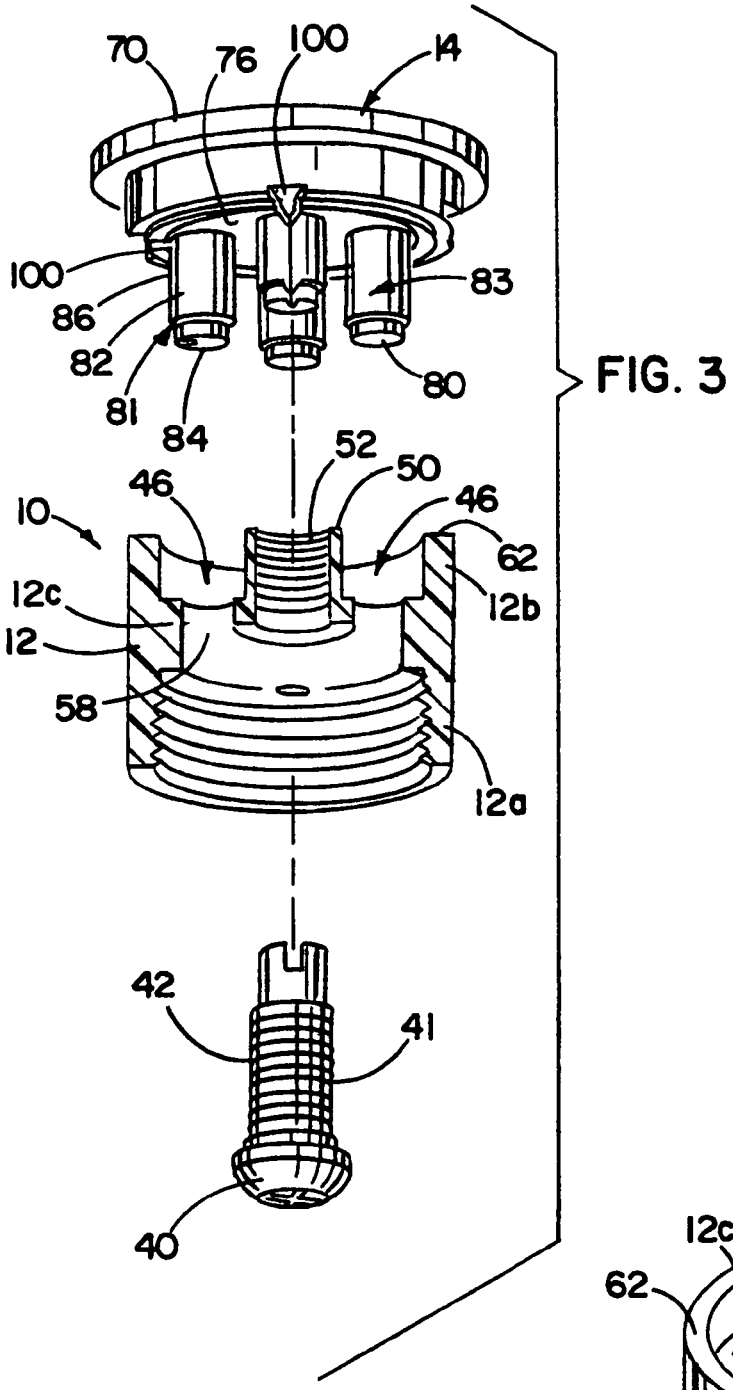
FIG. 3. is an exploded view in partial cross-section of the spray head of FIG. 1.
Figure 4:
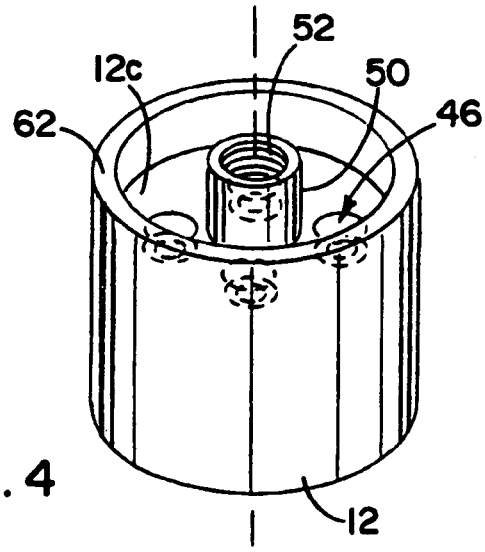
FIG. 4 is a perspective view of a base assembly of the spray head of FIG. 1.

As indicated above, the base assembly 12 includes the disc portion 12*c* with the boss 50 rising therefrom, and the throttling screw 42 threadably extends through the boss 50. As can be seen in FIGS. 2 and 3, the boss 50 includes a central threaded bore 52 for threadably receiving the throttling screw 42.

The disc portion 12*c* is equipped with a plurality of ports 46 radially located around and outboard of the boss 50. In the present embodiment, each port 46 has a countersink portion 54 that forms a shoulder 56 within the port 46 and a bottom portion or flow channel 58, which is narrower than the countersunk portion 54.

The spray head 10 further includes a deflector cap 14 which, in conjunction with the upper portion 12*b* of the base assembly, defines a plurality of outlet paths 17. The deflector cap 14 includes a generally disc-shaped body or cover 70 and a number of barrels 80 equally spaced and radially located on a bottom side 76 of the body 70. It is preferred that the number of barrels 80 is equal to the number of ports 46 and, in the present embodiment, four barrels 80 are provided for four ports 46. Therefore, each barrel 80 of the deflector cap 14 may be slideably inserted for a tight friction fit in its respective port 46. In this manner, the barrels 80 and ports 46 cooperate to provide securement between the deflector cap 14 and the base assembly 12.

The cover 70 is generally cylindrically shaped to match the shape of the cylindrical base assembly 12. The deflector cap 14 includes an aperture 78 generally located in the center of the deflector cap 14 and generally coaxial with axis X of the base assembly 12 such that deflector cap 14 permits access to the throttling screw 42 of the base assembly 12. The cover 70 is stepped to form a shoulder 74 joining with an annular flange 72 at the outermost portion of the cover 70. The annular flange 72 has a bottom that abuts and secures to an upper rim 62 of the base assembly 12 by any method that secures or provides an approximately water-tight seal such as adhesive or sonic welding. The shoulder 74 and bottom side 76 generally define an edge 75.

Figure 5:
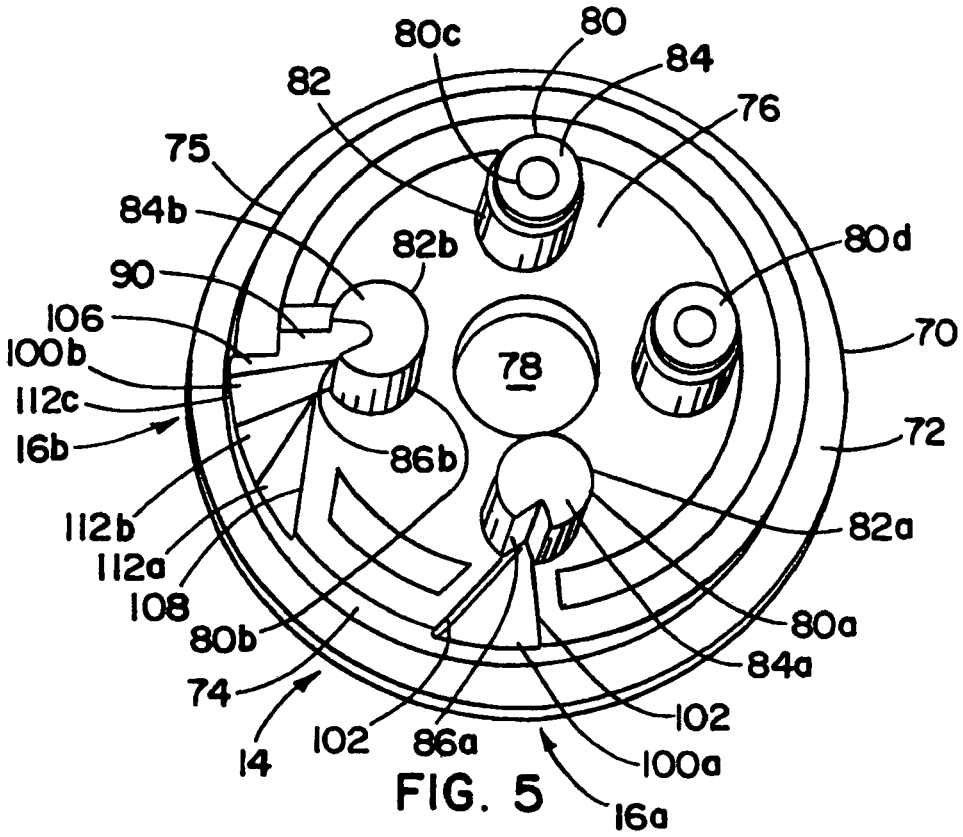
FIG. 5 is a bottom perspective view of a deflector cap of the spray head of FIG. 1.

As best viewed in FIG. 3, each barrel 80 is either an open barrel, such as barrels 80*a*, 80*b* (FIG. 5), or closed barrels 80*c*, 80*d* (FIG. 5). More specifically, the closed barrels 80*c*, 80*d* are structured such that, when secured in its respective port 46, water is not able to pass through the port 46 and by the closed barrel. The open barrels 80*a*, 80*b* are formed such that, when secured in their respective port 46, water is able to pass through the port 46 and by the open barrels 80*a*, 80*b*. In the present embodiments, the ports 46 and barrels 80 are each generally cylindrical, while the open barrels 80*a*, 80*b* include an open water channel 86 formed in a portion of the barrels 80*a*, 80*b* such that water may pass through the water channels 86*a*, 86*b* and the port 46. It should be noted that the ports 46 and barrels 80 may have any cooperating geometries such that the closed barrels 80*c*, 80*d* and their respective ports 46 cooperate to generally prevent water from passing therethrough while the open barrels 80*a*, 80*b* and their respective ports 46 permit water passage therethrough.

In their cylindrical form, the barrels 80 have an outside, generally cylindrical surface 82 depending from the bottom side 76 of the body 70 of the deflector cap 14. The surface 82 terminates at a lower or bottom wall 84.

The water channel 86 may be constructed with various shapes. For instance, the water channel 86 may have a constant depth from the bottom wall 84 to the bottom side 76 of the deflector cap 14, may have a depth that decreases from the bottom wall 84 to the bottom side 76 such that the water passing through is focused into a more concentrated spray, may have an arcuate depth such that the water passing therethrough is redirected for outward projection, or may have a depth that increases from the bottom wall 84 to the bottom side 76 such that air is added to the water spray or such that the fluid flow transitions from laminar to turbulent, thus creating a more dispersed projected water spray. In addition, the water channel 86 may be provided with a cross-section of a V-shape, a U-shape, or some other shape, depending on the expected input flow and desired discharge flow characteristics.

As mentioned above, the deflector cap 14 and the base assembly 12 define outlet path 17 for each of the nozzles 16*a*, 16*b*. Each barrel 80 is generally aligned with one of the outlet paths 17 and one of the nozzle plates 100 formed by a portion of the bottom side 76 of the deflector cap 14. Each open barrel 80*a*, 80*b* cooperates with the nozzle plate 100 and the respective outlet path 17 to form one of the nozzles 16*a*, 16*b*. In the preferred embodiment, the sprinkler or spray head 10 includes at least two nozzles 16*a* and 16*b* for distributing respective water spray patterns outward from the spray head 10, though more nozzles 16 may be utilized by the same spray head 10 depending on the size of the spray head, the area to be watered, the spray pattern desired, and the particular application of use. As it is preferred that respective nozzles 16 provide water spray patterns with different profiles, the geometry of the nozzles 16 is varied by varying either the outlet path 17, the channel 86 of the open barrels 80*a*, 80*b*, or the nozzle plate 100, as will be discussed below.

Figure 6A:
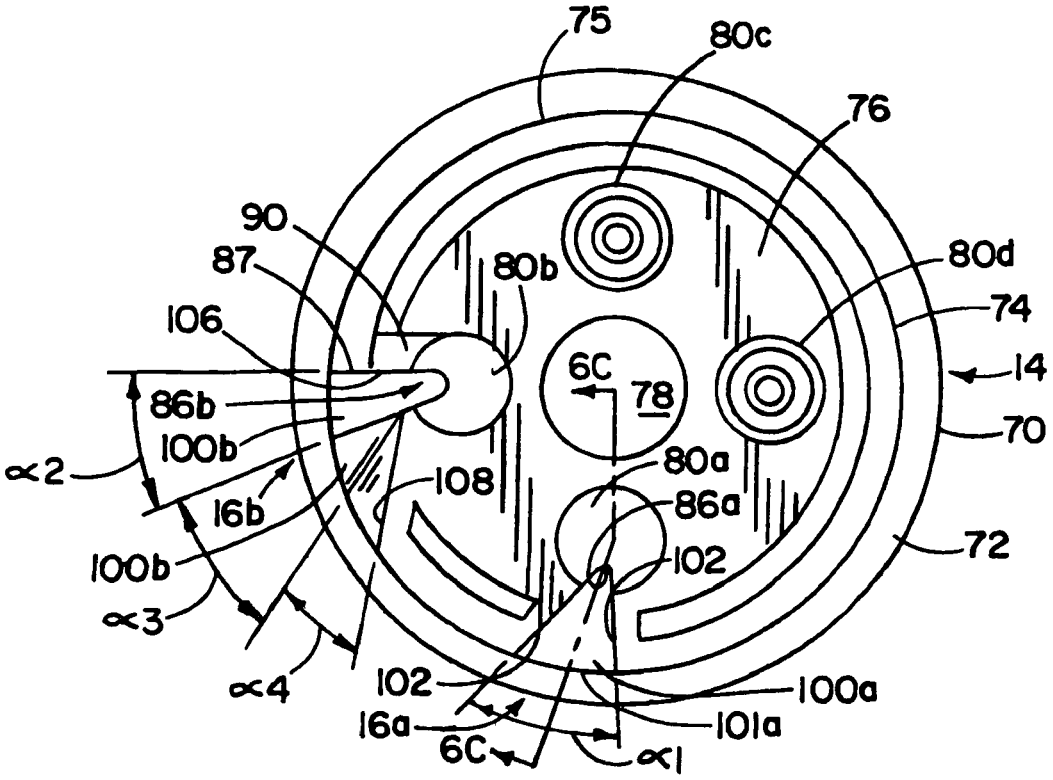
FIG. 6A is a bottom plan view of the deflector cap of FIG. 5.
Figure 6B:
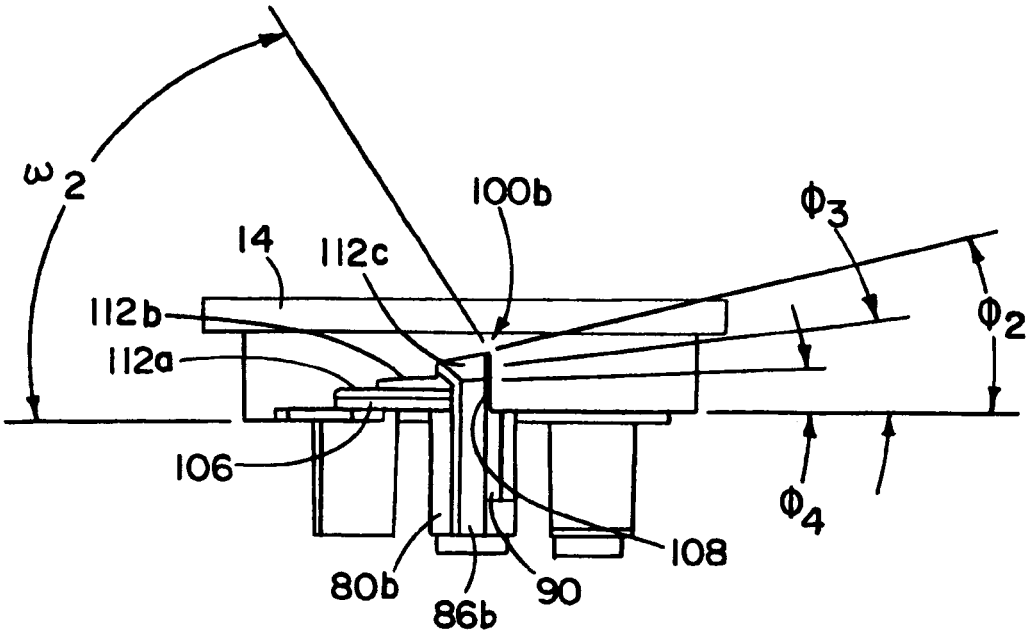
FIG. 6B is a side elevational view of the deflector cap of FIG. 5.
Figure 6C:
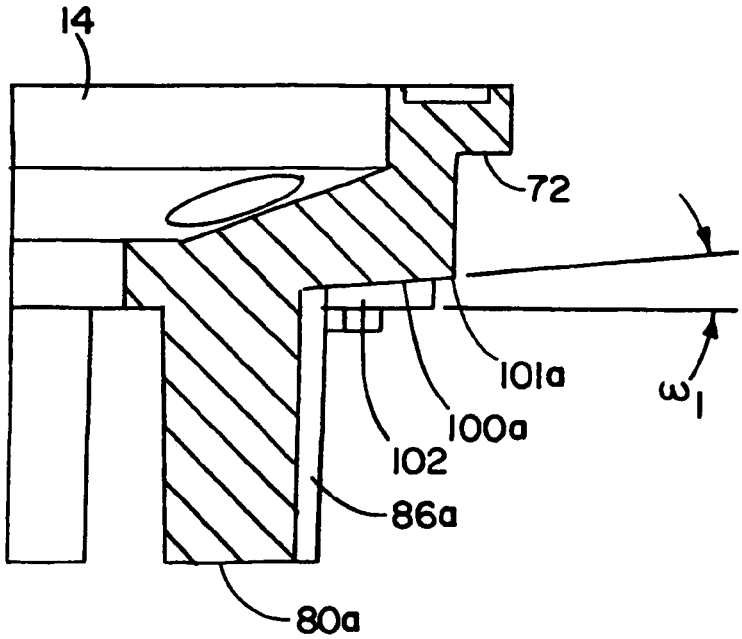
FIG. 6C is a cross-sectional view of the deflector cap of FIG. 6 taken along line 6-6 of FIG. 6.

For instance, as illustrated in FIGS. 5 and 6, deflector cap 14 may include four barrels. Of these, two may be open barrels 80*a*, 80*b* and the other two may be closed barrels 80*c*, 80*d*. Barrels 80*a*, 80*b* cooperate with an outlet path to form nozzles 16*a* and 16*b*, while barrels 80*c* and 80*d* are closed barrels and do not form nozzles. The barrel 80*a* includes a V-shaped channel 86*a*, extending longitudinally from the bottom side 76 of the body 70 to the bottom wall 84*a* of the barrel 80*a*, while barrel 80*b* utilizes a U-shaped channel 86*b* and projection 90 located adjacent to and outboard from a side 82*b* of the barrel 80*b* and an edge 87 of the channel 86*b*. The projection 90 provides a water spray pattern that has a sharp, straight edge to prevent overspray. That is, the projection 90 guides the water generally down the longer edge of a rectangular area and provides a sharp cutoff of the water spray on this edge. The varying characteristics of the channels 86*a*, 86*b* influence the resulting water spray pattern emitted from the nozzles 16*a*, 16*b*. The depth of channels 86*a*, 86*b* can affect the throw distance of the water spray from the spray nozzle. For example, a deeper channel, such as channel 86*b*, allows more water therethrough resulting in a water spray pattern having a larger throw distance.

In addition, varying nozzle plates 100 produce different water spray patterns. The open barrels 80*a*, 80*b* cooperate with respective nozzle plates 100*a*, 100*b* preferably defined by the bottom portion of the deflector cap 14 for discharging water from the nozzles 16*a*, 16*b*. In operation, for example, water flows through the flow channel 58 of the base assembly 12 and through the channel 86 of the open barrel 80*a* until the water strikes the nozzle plate 100*a*. The nozzle plate 100*a* imparts the desired output trajectory to the water emitted from the outlet path 17*a*, and nozzle 16*a*, as indicated by the water flow arrows. The same operation occurs for nozzle 16*b*. As with the channels 86*a*, 86*b*, varying characteristics of the nozzle plates 100*a*, 100*b* influence the resulting water spray pattern emitted from the nozzles 16*a*, 16*b*.

More specifically, for barrel 80*a*, the preferred nozzle plate 100*a* is formed as a recess in bottom side 76 of the deflector cap 14 with side walls 102 for constraining the flow of the water therebetween. The top portion of the channel 86*a* of the open barrel 80*a* is coincident with a portion of the nozzle plate 100*a* such that water passing through the channel 86*a* is forced against the nozzle plate 100*a*. The water is then forced to turn in an outward direction for emission. In the absence of any constraint, water striking the nozzle plate 100*a* would flow in a radiating pattern from the point of impact. So that the water is directed outward from the spray head 10, the walls 102 of nozzle plate 100*a* constrain the direction of flow. In the preferred embodiment, the walls 102 form a V-shape similar to the shape of the channel 86*a*.

The shape of nozzle plate 100*a* may be varied. For instance, in an outboard or radial direction, the recess in which the nozzle plate 100*a* may have a uniform depth or may be raked to alter the throw distance. For example, the throw distance is controlled by a trajectory or rake angle $\omega 1$ of the nozzle plate 100*a*, which is angled upwardly away from the barrel 80*a*. In the preferred embodiment, it has been found satisfactory that the nozzle plate 100*a* has a rake angle between about 2° and 6° and, most preferably, about 4°. The amount of water exiting from the nozzle plate 100*a* is generally uniformly distributed across the outboard edge 101*a* of the nozzle plate 100*a* with a sweep angle $\Theta$. The sweep angle $\Theta$ (see FIG. 7) of water emitted from the nozzle 16*a* is dependent on a dispersal angle $\alpha_1$ (FIG. 6) formed between the walls 102. Preferably, the dispersal angle $\alpha_1$ is between about 46° and about 50° and, most preferably, about 48°. The rake angle $\omega_1$ and dispersal angle $\alpha_1$ of nozzle plate 100*a* project a water spray pattern that is generally triangular or wedge-shaped, which covers area 126 that is proximate or close-in to the spay head 10. Although ranges for the rake angle and dispersal angle are provided above, it is believed that other angles also provide acceptable results.

Similarly, barrel 80*b* is provided with nozzle plate 100*b*. That is, the nozzle plate 100*b* includes side walls 106, 108 for constraining and directing the radial emission of water flow from the nozzle 16*b*. In addition, the nozzle plate 100*b* is stepped to form a series of consecutive vanes 112*a*, 112*b*, 112*c*. Each vane 112 is stepped downwardly from a preceding vane 112 such that the size of the outlet path 17 proximate to each vane 112*a*, 112*b*, 112*c* is stepped and/or such that the trajectory of the water being emitted proximate to each vane 112*a*, 112*b*, 112*c* is stepped. In this manner, the water spray being emitted by the nozzle 16*b* is a combination of consecutive spray patterns that form a continuous pattern that has portions which reach different distances with different water volumes. Accordingly, ground area of varying distances from the nozzle 16*b* receive generally identical volumes of water, and water is not projected beyond the desired ground area.

Figure 7:
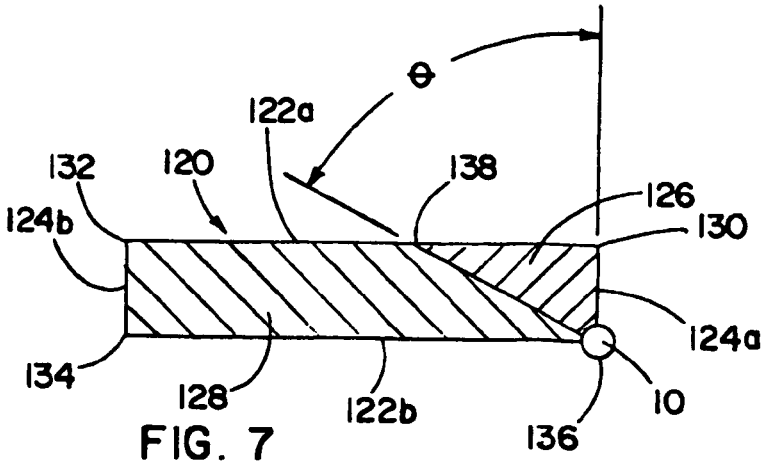
FIG. 7 is a representational view of a spray pattern and coverage area for the spray head of FIG. 1.
Figure 8:
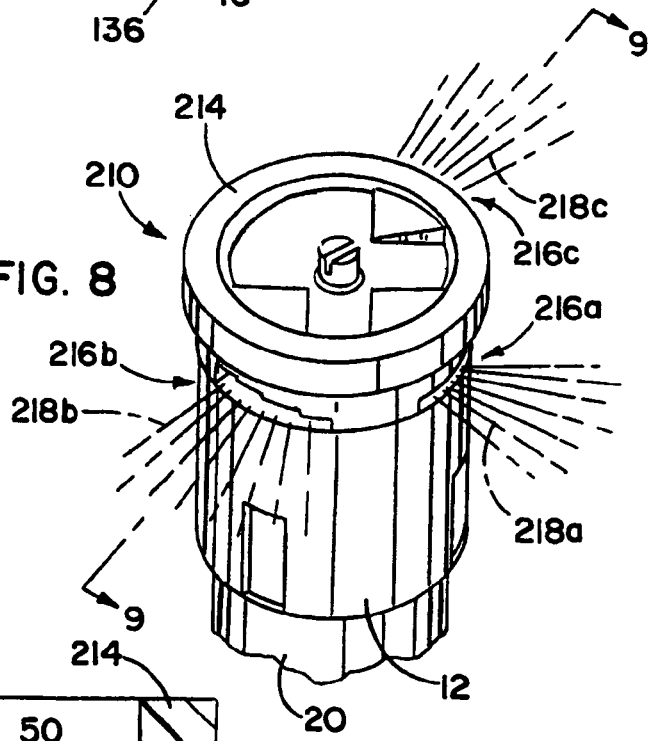
FIG. 8 is a perspective view of a second embodiment of a spray head embodying features of the present invention.
Figure 9:
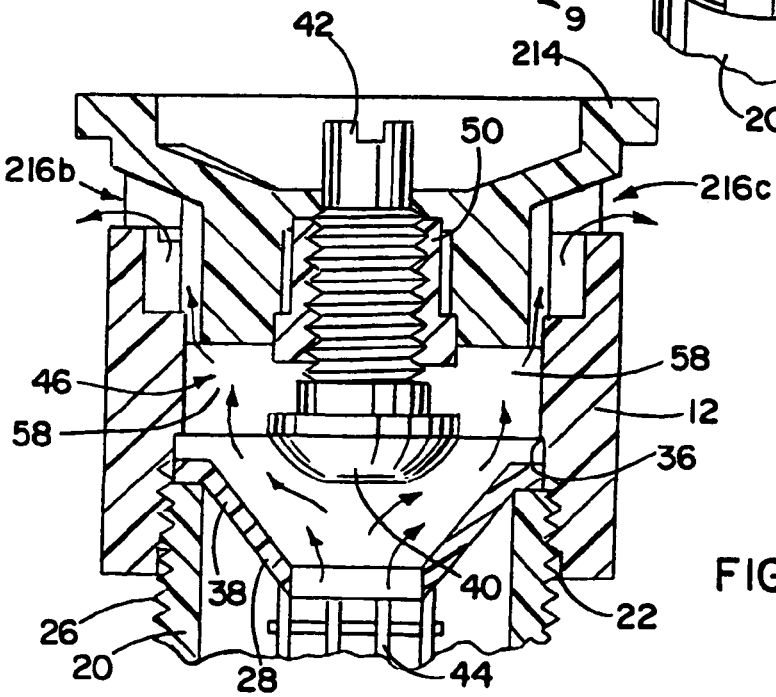
FIG. 9 is a cross-sectional view of the spray head of FIG. 8 taken along line 9-9 of FIG. 8.
Figure 10:
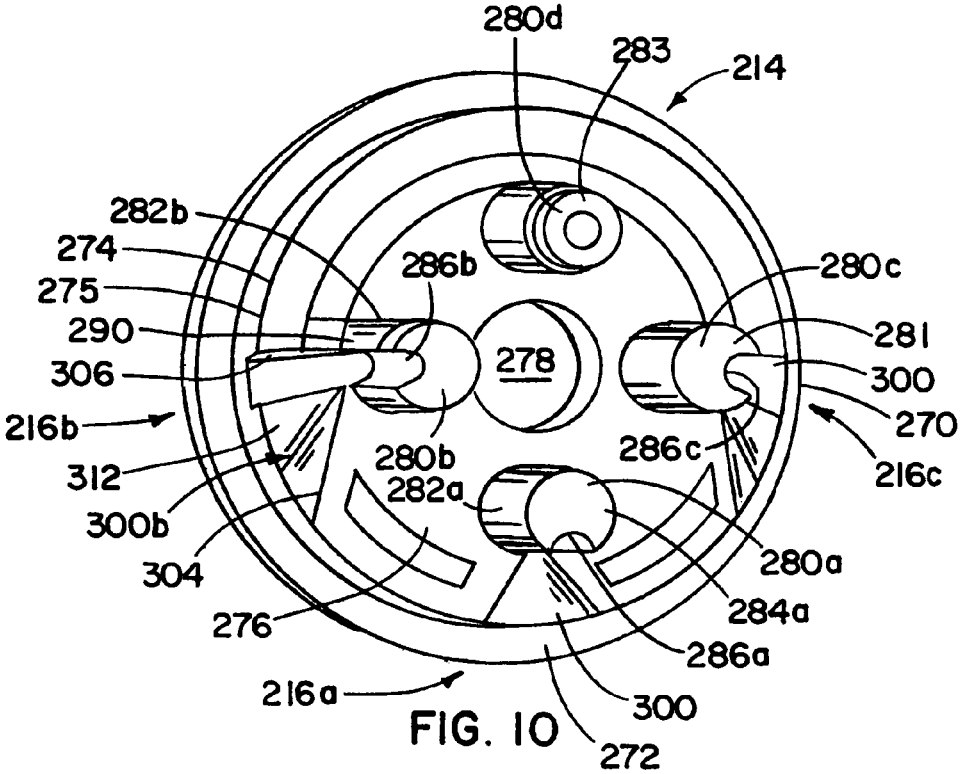
FIG. 10 is a bottom perspective view of a deflector cap of the spray head of FIG. 8.
Figure 11:
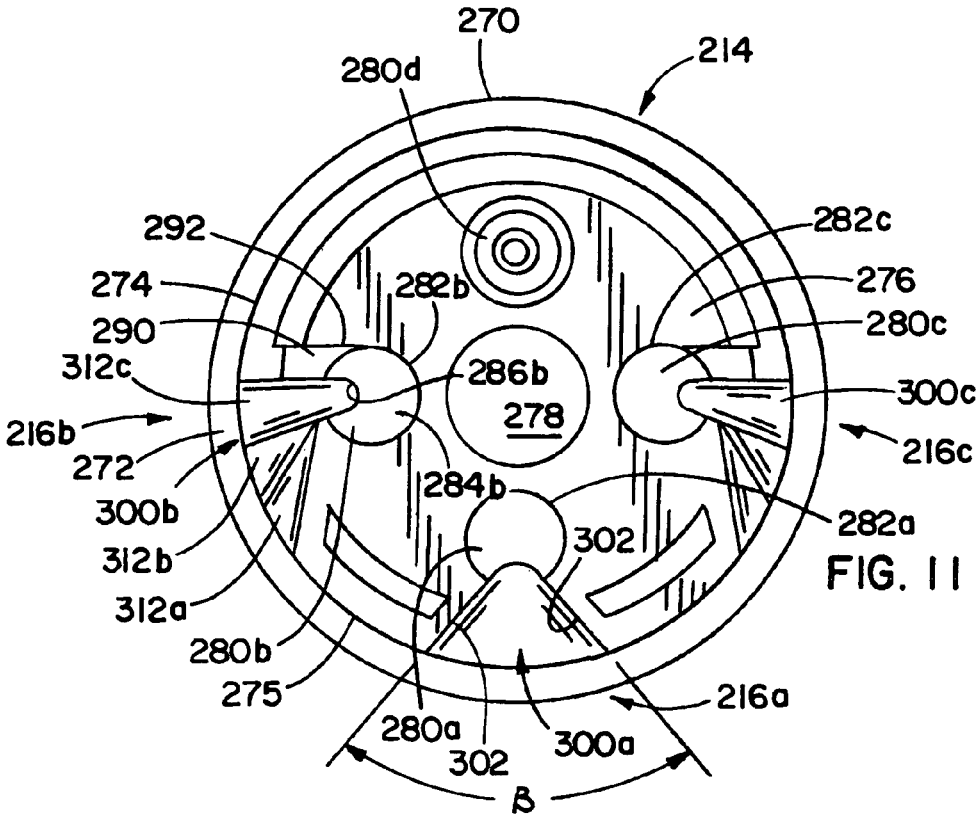
FIG. 11 is a bottom plan view of the deflector cap of FIG. 10.

Each vane 112 is tilted, raked, and has a dispersal angle to form a water spray pattern having a predetermined throw distance and sweep angle $\Theta$. For example, the vane 112*c* extends outwardly from channel 86*c* to generally provide the furthest spray pattern from nozzle plate 100*b*. That is, the vane 112*c* forms a spray pattern down the longer edge of the rectangular area. Preferably, the vane 112*c* has a tilt angle $\phi_2$, which is the angle of the vane surface relative to the base surface 76, between about 11° and about 15° and, most preferably, of about 13°. The vane 112*c* also has a trajectory or rake angle ω2, which is the angle that the vane 112*c* extends outwardly away from the barrel 80*b*, between about 18° and about 22° and, most preferably, of about 20°. The vane 112*c* further has a dispersal angle $\alpha_2$ defined by the edges of the vane between about 18° and about 22° and, most preferably, of about 20°. The vane 112*b* is stepped upwardly from the vane 112*c* and generally provides a spray pattern having an intermediate throw distance and the widest sweep angle from nozzle plate 100*b*. Preferably, the vane 112*b* has about a 0° rake or trajectory, a tilt angle $\phi_3$ between about 4° and about 8°, and a dispersal angle $\alpha_3$ between about 39° and about 43°. Most preferably, the vane 112*b* has a tilt angle $\phi_3$ of about 6° and a dispersal angle $\alpha_3$ of about 41°. The vane 112*a* is stepped upwardly from the vane 112*b* and generally provides a spray pattern having a shorter throw distance and sweep angle that fills in the gap between the spray patterns from the vane 112*b* and the nozzle plate 100*a*. Preferably, the vane 112*a* has a 0° rake or trajectory, a tilt angle $\phi_4$ between about 0° and about 3°, and a dispersal angle $\alpha_4$ between about 17° and about 21°. Most preferably, the vane 112*a* has a tilt angle $\phi_4$ of about 1° and a dispersal angle $\alpha_4$ of about 19°. The characteristics of the nozzle plate 100*b* project a combined water spray pattern that is generally trapezoidal shaped, which covers area 128 (FIG. 7). Although ranges for the rake, tilt angle, and dispersal angle are provided above, it is believed that other angles also provide acceptable results.

In this manner, the spray head 10 utilizes nozzles 16*a* and 16*b* that emit water sprays 18*a*, 18*b* with different profiles. Each different profile waters the ground with a different spray pattern. Referring now to FIG. 7, a ground surface area 120 is represented as a generally rectangular area including areas 126 and 128. The ground area 120 is defined by side edges 124*a* and 124*b*, base edges 122*a* and 122*b*, and corners 130, 132, 134, and 136. As shown, area 120 is generally rectangular and is, for example, four to six feet wide by fifteen to twenty feet long at a fluid pressure of 30 psi. The spray head 10 is installed or positioned at the corner 136 and the spray patterns from the nozzles 16*a* and 16*b* combine to water the entire area 120.

The nozzle 16*a* projects a water spray 18*a* that covers the ground in a generally wedge-shape pattern, and the spray head 10 utilizes the nozzle 16*a* to water the area 126. It should be noted that the nozzle 16*a*, as described, uses a wedge-shaped pattern with a maximum water throw being the distance from corner 136 to point 138. As this pattern is used to cover a triangular-shaped area, the amount of nozzle 16*a* overspray is limited to the area beyond the area 126 that is within the maximum throw distance. To further limit this overspray, the nozzle plate 100*a* of the nozzle 16*a* could be constructed in a manner similar to that of nozzle 16*b*.

As discussed, nozzle 16*b* utilizes vanes 112 to project water with varying trajectories and flow rates such that each vane 112*a*, 112*b*, 112*c* directs water with a maximum specific distance. The maximum distance water is projected from each vaned portion of the nozzle plate 100*b* is calibrated for the distance from the spray head 10 at corner 136 to the portion of the 122*a* and 124*b* towards which each vaned portion is directed. In this manner, the water spray pattern 18*b* emitted from the nozzle 16*b* generally covers the ground area represented as area 128.

More specifically, the nozzle 16*b* is configured to project a generally right-trapezoidal-shaped spray pattern over area 128. That is, area 128 is generally a trapezoid having a right angle or is generally the trapezoid formed when a triangle is removed from a rectangle. Specifically, when spray head 10 is positioned at corner 136 of the rectangular surface area 120, the area 128 watered by the spray nozzle 16*b* extends down the base edge 122*b* from the corner 136 to the corner 134, up the side edge 124*b* from the corner 134 to the corner 132, and along the base edge 122*a* from corner 132 to the point 138. When positioned at such corner, the projection 90 guides a water spray along the base edge 122*b* of the right-trapezoid. The vanes 112 are positioned and angled to guide and project water in consecutive sprays, which correspond to each vane 112, outwardly from the spray nozzle 16*b* in discrete spray patterns of water that sequentially cover area 128 in the generally right-trapezoidal shape.

As can be seen, the geometry provided for the nozzle plates 100*a* and 100*b* for their respective nozzles 16*a* and 16*b* can be varied by using stepped vanes 112 to produce spray patterns that can cover areas that include a right angle. The size and shape of the channel 86 in each open barrel 80*a*, 80*b* may be varied to control the volume and pressure of water flow through each nozzle 16, thereby influencing the distance and dispersement of the water spray pattern. When directing a nozzle to water an area bounded by a straight line, less precision and fewer vanes are required when the straight line is positioned relatively close to the nozzle, while greater precision and more vanes (which provide a great portion of the precision) are preferable when the straight line is positioned relatively far from the nozzle. The use of sidewalls such as 102, 106, and 108 may be used to define the sweep angle for each area to be watered by a particular nozzle 16, as can the use of projection 90, thus assisting in minimizing spray overlap by the nozzles 16. Accordingly, when both nozzles 16*a* and 16*b* are utilized by the spray head 10, both areas 126, 128 are covered, preferably without significant overlap or watering outside area 120. Consequently, the spray head 10 efficiently waters rectangular area 120 in a matter that facilitates a low SC.

To minimize overlap between water spray patterns 18*a* and 18*b*, the trajectory or rake angles of the nozzles 16*a* and 16*b* are varied. For instance, as previously discussed, nozzle 16*a* preferably has a trajectory or rake angle of about 4°. In this configuration, the water spray 18*a* is projected outwardly from the spray head 10 and extends to about the four foot area ahead of the spray head 10. To prevent significant overlap or mixing of the spray pattern 18*a* with the spray pattern 18*b*, vane 112*a* of the spray nozzle 16*b* has a trajectory or rake angle different than the rake angle of nozzle 16*a*. Preferably, as previously discussed, vane 112*a* has a trajectory angle of about 0°. This different rake angle allows the spray pattern 18*b* to leave the nozzle 16*b* at a lower trajectory and merge with the spray pattern 18*a* at about two feet from the spray head 10. In this configuration, the overspray of the spray patterns 18*a* and 18*b* is minimized and the overlap is sufficient to prevent a dry area between the nozzles 16*a* and 16*b*. While the trajectory angles discussed above for nozzle 16*a* and vane 112*a* have been found satisfactory to prevent dry areas and minimize spray pattern overlap, it is believed that other trajectory angles will also provide satisfactory results.

Figure 12:
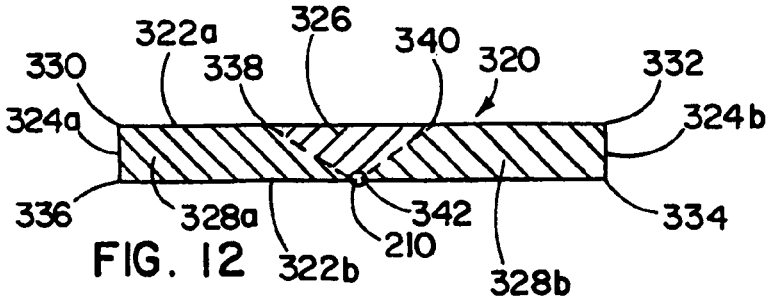
FIG. 12 is a representational view of a spray pattern and coverage area for the spray head of FIG. 8.

A second embodiment of a spray head 210 is illustrated in FIGS. 8 through 12 to demonstrate variations for the nozzles 16 of spray head 10. That is, spray head 210 may be utilized for watering an area 320 when the spray head 210 is positioned generally at a central point on one side of the area 320, not at a corner as in the previous embodiment. As illustrated in FIG. 12, for example, the ground area 320 generally consists of side edges 324*a* and 324*b* and base edges 322*a* and 322*b* that create corners 330, 332, 334, and 336. The area 320 is generally rectangular, and preferably, four feet wide by thirty feet long. The spray head 210 is position approximately centrally between the corners 334 and 336 along the edge 322*b* at point 342. When installed at point 342, the spray head 210 projects water to generally cover the area 320 by the combination of water sprays from three nozzles 216 without significant overlap of the water spray patterns and without significant watering outside surface area 320.

In general, the spray head 210 includes the base assembly 12 secured to a deflector cap 214 to form spray nozzles 216 for emitting projecting water spray patterns 218 with a specific spray profile to cover ground areas with particular spray patterns. As shown, the spray head 210 has three spray nozzles 216*a*, 216*b*, and 216*c* for projecting three spray profiles 218*a*, 218*b*, and 218*c*. Similar to spray head 10, each spray nozzle 216*a*, 216*b*, 216*c* is defined by an open barrel 280*a*, 280*b*, 280*c*, a channel 286*a*, 286*b*, 286*c*, and a nozzle plate 300*a*, 300*b*, 300*c* formed in the bottom side 276 of the deflector cap 214, each being similar to the corresponding elements for spray head 10.

As described above, the geometry provided for the nozzle plates 300 and for their respective nozzles 216*a*, 216*b*, 216*c* can be varied by using stepped vanes 312 to produce spray patterns that can cover areas that include a right angle, and the depth of the channel 286 may be varied to control the volume and pressure of the flow through the nozzle 216, thereby influencing the distance and dispersement of the water spray.

Accordingly, the spray head 210 includes a front-spray nozzle 216*a* and two side-spray nozzles 216*b* and 216*c* that are mirror-images of each other. The front-spray nozzle 216*a* is defined by a cylindrical barrel 280*a* having a U-shaped channel 286*a*, while the side-spray nozzles 216*b*, 216*c* have deeper U-shaped channels 286*b*, 286*c*, respectively, and projection 290 extending from the side wall 282*b*, as has been described for spray head 10.

Each nozzle 216 is accompanied by a nozzle plate 300. More specifically, the front-spray nozzle 216*a* utilizes a nozzle plate 300*a* similar to nozzle plate 100*a* and having a uniform depth and side walls 302 such that water is emitted from the front-spray nozzle 216*a* to cover an arcuate wedge-shaped area, represented as 326 in FIG. 12.

Side-spray nozzles 216*b*, 216*c* include nozzle plates 300*b*, 300*c* having stepped vanes 312, which operate identically to the vanes 112 described above, such that the each portion of nozzles 216*b*, 216*c* proximate to the stepped vanes 312 direct water with a maximum specific distance. The maximum distance water is projected from each vaned portion of the nozzle plate 300*b*, 300*c* is calibrated for the distance from the spray head 210 at point 342 to the portion of the side edges 324*a* and 324*b* and base edges 322*a* and 322*b* of the area 320 towards which each vaned portion is directed. Each vaned nozzle plate 300*b*, 300*c* is bounded by projection 290, as described, and wall 304 to constrain and direct the water spray pattern in the desired direction. In this manner, the water spray patterns 218*b*, 218*c* emitted from the nozzles 216*b*, 216*c* generally cover ground areas respectively represented as right-trapezoidal areas 328*a* and 328*b* and including right angles at corners 330, 332, 334, and 336.

In operation, spray head 210 projects a plurality of water spray patterns 218 to cover area 320. That is, the front-spray nozzle 216*a* emits a water spray pattern 218*a* for covering area 326, side-spray nozzle 216*b* emits a water spray pattern 218*b* to cover the area 328*a*, and side-spray nozzle 216*c* emits a water spray pattern 218*c* to cover the area 328*b*.

Because each spray nozzle 216 is sized and shaped to project a predetermined spray pattern 218, each spray nozzle 216 waters a predetermined section or sub-area of the area 320. For instance, the front-spray nozzle 216*a* projects a generally triangularly or wedge-shaped water-spray pattern 218*a* over sub-area 326 extending from spray head 210 in the radial direction towards edge 322*a* from about a 10 o'clock to about a 2 o'clock position extending from point 338 to point 340 along edge 322*a*. Spray pattern 218*a* preferably waters up to, but not significantly beyond, edge 322*a*. Front-spray nozzle 216*a* projects water in a manner similar to spray nozzle 16*a*, though over a larger arc or sweep as determined by angle β between the walls 302 bounding the nozzle plate 300*a*.

Similarly, the side-spray nozzle 216*b* projects a spray pattern 218*b* that preferably projects water spray over generally left-trapezoidal sub-area 328*a*. That is, area 328*a* is generally a trapezoid having a right angle or is generally the trapezoid formed when a triangle is removed from a rectangle. For instance, area 328*a* extends down edge 322*b* from the position of spray head 210 at point 342 towards corner 336, up edge 324*a* from corner 336 to corner 330, and back along edge 322*a* from corner 330 to point 338. Since the side-spray nozzle 216*c* is a mirror image of the side-spray nozzle 216*c*, side-spray nozzle 216*c* also projects a spray that preferably projects water spray over generally right-trapezoidal sub-area 328*b*. Spray nozzle 216*b* and 216*c* operate in a manner similar to spray nozzle 16*b*.

As previously discussed, the combination of the generally triangular-shaped areas 326 and the generally right-trapezoidal-shaped areas 328*a*, 328*b* form the combined rectangular area 320. Preferably, the areas covered by each nozzle 216 do not significantly overlap, and the nozzles 216 do not significantly water outside the area 320. Consequently, with the combination of the three spray patterns 218, the spray head 210 efficiently waters the area 320 resulting in a low SC. As with the spray head 10, the overlap of the spray patterns 218 is minimized by varying the trajectory or rake angles of the nozzle 216*a* and the vanes 312*a* in nozzles 216*b* and 216*c* in a similar manner.

Figure 13:
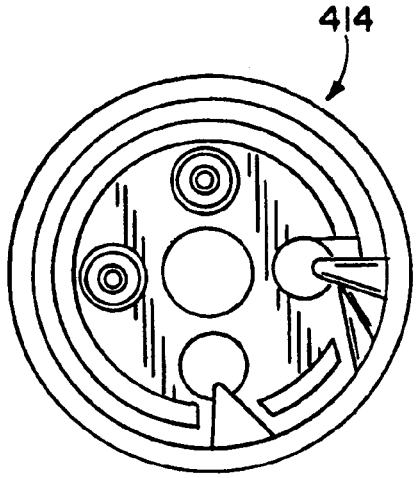
FIG. 13 is a bottom plan view of a third embodiment of a spray head embodying features of the present invention.

Referring to FIG. 13, a third embodiment of a deflector cap 414 is illustrated. The deflector cap 414 is a mirror image of deflector cap 14 (FIGS. 5 and 6) and operates in an identical manner, except that the deflector cap 14 is a right corner strip nozzle (RCS) and deflector cap 414 is a left corner strip nozzle (LCS). That is, a spray head, such as spray head 10, equipped with the deflector cap 414 would be positioned at a right hand corner for distributing water in the left hand direction. The deflector cap 414 is merely a mirror image of deflector cap 14 and includes all the components thereof.

It will be understood that various changes in the details, materials, and arrangements of parts and components, which have been herein described and illustrated in order to explain the nature of the invention may be made by those skilled in the art within the principle and scope of the invention as expressed in the appended claims.

What is claimed is:

1. A spray head for distributing a flow of liquid comprising:

a base for connecting to a pressurized source of liquid and defining at least in part a first flow path and a second flow path for the liquid from the pressurized source;

a first deflector cap cooperating with the base to define at least in part a first outlet path and a second outlet path from the spray head and to direct liquid from the first flow path through the first outlet path and from the second flow path through the second outlet path for distribution from the spray head to adjacent ground surface areas;

the deflector cap defining a first recess at the first outlet path, the first recess having a predetermined shape such that liquid is discharged from the spray head in a direction and pattern defined by the shape of the first recess, the first recess defined in part by a plurality of stepped surfaces of the deflector cap, each surface varies a portion of the flow such that liquid is discharged from the spray head with a pattern varying in size and distance; and the deflector cap defining a second recess at the second outlet path, the second recess having a predetermined shape such that liquid is discharged from the spray head in a direction and pattern defined by the shape of the second recess.

2. The spray head of claim 1 wherein the first recess deflects a portion of the liquid such that the pattern of liquid being discharged from the spray head has at least one generally straight boundary.

3. The spray head of claim 2 wherein the first recess varies the trajectory and volume across the pattern of the liquid being discharged from the spray head.

4. The spray head of claim 3 wherein the pattern of liquid being discharged from the spray head includes at least two generally straight boundaries that are disposed generally at right angles to one another.

5. The spray head of claim 1 wherein the base defines at least in part a second flow path for the liquid from the pressurized source, and the deflector cap cooperating with the base to define at least in part a second outlet path from the spray head and to direct liquid from the second flow path through the second outlet path for distribution from the spray head.

6. The spray head of claim 5 wherein the liquid distributed from the first outlet path and liquid from the second outlet path do not significantly overlap one another.

7. The spray head of claim 5 wherein the deflector cap defines a second recess at the second outlet path, the second recess having a predetermined shape such that liquid is discharged from the spray head in a directed and pattern defined by the shape of the second recess.

8. The spray head of claim 7 wherein the base defines at least in part a third flow path for the liquid from the pressurized source, and the deflector cap cooperating with the base to define at least in part a third outlet path from the spray head and to direct liquid from the third flow path through the third outlet path for distribution of liquid from the spray head.

9. The spray head of claim 8 wherein the liquid distribution from the first outlet path, the second outlet path and the third outlet path do not significantly overlap.

10. The spray head of claim 5 wherein the first recess is defined in part by a plurality of stepped surfaces of the deflector cap, each surface varies portions of the flow such that the liquid is discharged from the spray head with a pattern varying in size and distance.

11. A spray head comprising:

a deflector cap having a surface and an edge;

a base for receiving at least a portion of the deflector cap and for communicating with a fluid source;

at least a first spray nozzle defined by the deflector cap surface and the base and having a stepped deflector portion on the deflector cap surface defined by a plurality of vanes wherein each vane is stepped upwardly from a proceeding vane for directing a plurality of fluid spray patterns outwardly from the spray nozzle to cover a first ground area defined generally as a trapezoid;

at least a second spray nozzle defined by the deflector cap surface and the base and having a predetermined shape configured for projecting fluid outwardly therefrom to cover a second ground area defined generally as a triangle; and wherein the fluid from the spray nozzles generally covers a combined surface area having a width and a length such that the area covered by each spray nozzle does not significantly overlap an area covered by another spray nozzle.

12. The spray head of claim 11 wherein each spray nozzle does not significantly spray outside of its respective ground area.

13. The spray head of claim 11 wherein the deflector cap includes at least one barrel, the base includes at least one port, and the barrel is received in the port for securing the cover to the base.

14. The spray head of claim 13 wherein the first spray nozzle is at least partially defined by a channel formed in the barrel depending from the deflector cap surface.

15. The spray head of claim 14 wherein the barrel is generally cylindrical and the channel extends longitudinally along a cylindrical surface of the barrel such that the channel directs a fluid flow therethrough.

16. The spray head of claim 15 wherein the channel is in fluid communication with the stepped deflector portion of the deflector cap, and the stepped deflector portion cooperates with the channel to form a spray profile for fluid flowing therethrough.

17. The spray head of claim 11 wherein the stepped deflector portion includes a side wall for directing the projection of fluid.

18. The spray head of claim 11 wherein the stepped deflector portion includes a protrusion for guiding a fluid spray outwardly from the spray nozzle, the protrusion disposed on the deflector cap surface extending outwardly from one of the barrels and having a first edge abutting the channel.

19. The spray head of claim 11 wherein the spray head projects fluid over a generally rectangular area.

20. The spray head of claim 19 wherein the spray head may be positioned at a corner of the generally rectangular area.

21. The spray head of claim 19 wherein the spray head may be positioned along a side of the generally rectangular area.

22. A spray head comprising:

a base assembly having a plurality of ports;

a deflector cap having a bottom surface and an edge;

a plurality of spray nozzles formed by the deflector cap bottom surface and ports of the base, wherein the deflector cap is securable with the base assembly such that a portion of each spray nozzle is received in one of the ports;

at least one of the spray nozzles having a stepped deflector portion defined by a plurality of vanes wherein each vane is stepped upwardly from a preceding vane for directing a plurality of fluid spray patterns outwardly therefrom to cover a generally trapezoidal ground area; and another of the spray nozzles having a predetermined shape configured for projecting fluid outwardly therefrom to cover a generally triangular ground area, wherein the ground areas are adjacent to each other and may be combined to cover approximately a generally rectangular surface area substantially free of overlap between the adjacent ground areas and substantially free of overspray.

23. The spray head of claim 22 including a third spray nozzle.

24. The spray head of claim 23 wherein the stepped deflector portion includes a structure extending along the deflector portion for directing the projection of fluid from the nozzle.

25. The spray head of claim 22 wherein each spray nozzle is further defined at least in part by a barrel depending from the surface of the deflector cap and slideably received by one of the ports.

26. The spray head of claim 25 wherein the barrel is generally cylindrical and includes a longitudinally extending channel for directing fluid flow therethrough.

27. An irrigation system for watering an area comprising:

a spray head disposed on a edge of the area;

a plurality of spray nozzles disposed in the spray head;

one of the plurality of spray nozzles having a first predetermined shape configured for projecting a first spray pattern from the spray head covering a ground area approximately triangular shaped;

another of the plurality of spray nozzles having a stepped deflector portion defined by a plurality of vanes wherein each vane is stepped upwardly from a preceding vane for projecting a second spray pattern from the spray head covering a ground area approximately trapezoidal shaped; and wherein the triangular shaped ground area is substantially adjacent to the trapezoidal shaped ground area.

28. The irrigation system of claim 27 wherein the trapezoidal ground area and the triangular ground area may be combined to approximate a rectangle.

29. The irrigation system of claim 27 wherein the first and second spray patterns are projected such that the trapezoidal ground area and the triangular ground area do not significantly overlap.

30. The irrigation system of claim 27 wherein the spray patterns are not significantly sprayed beyond their respective triangular or trapezoidal areas.

* * * * *